US012767998B2

(12) United States Patent
Hasegawa et al.

(10) Patent No.: US 12,767,998 B2
(45) Date of Patent: Oct. 20, 2026

(54) HIGH-STRENGTH HOT-ROLLED STEEL SHEET AND METHOD FOR MANUFACTURING HIGH-STRENGTH HOT-ROLLED STEEL SHEET

(71) Applicant: JFE Steel Corporation, Tokyo (JP)

(72) Inventors: Hiroshi Hasegawa, Tokyo (JP); Hideyuki Kimura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 416 days.

(21) Appl. No.: 18/289,601

(22) PCT Filed: May 13, 2022

(86) PCT No.: PCT/JP2022/020291

§ 371 (c)(1),
(2) Date: Nov. 6, 2023

(87) PCT Pub. No.: WO2022/244706

PCT Pub. Date: Nov. 24, 2022

(65) Prior Publication Data

US 2024/0254584 A1 Aug. 1, 2024

(30) Foreign Application Priority Data

May 17, 2021 (JP) ..... 2021-083111

(51) Int. Cl.

| | |
|---|---|
| ***C21D 8/02*** | (2026.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 8/0226* (2013.01); *C21D 8/0263* (2013.01); *C21D 9/46* (2013.01); *C22C 38/002* (2013.01); *C22C 38/02* (2013.01); *C22C 38/04* (2013.01); *C22C 38/06* (2013.01); *C21D 2201/05* (2013.01); *C21D 2211/002* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 8,157,933 | B2 | 4/2012 | Yokoi et al. |
| 2014/0007993 | A1 | 1/2014 | Nakajima et al. |
| 2018/0237874 | A1 | 8/2018 | Yamazaki et al. |
| 2022/0259692 | A1 | 8/2022 | Yabu et al. |

FOREIGN PATENT DOCUMENTS

| | | | |
|---|---|---|---|
| EP | 2 896 715 | A1 | 7/2015 |
| EP | 2 987 887 | A1 | 2/2016 |
| JP | 2012062562 | A | 3/2012 |
| JP | 2014205890 | A | 10/2014 |
| JP | 2015-196891 | A | 11/2015 |
| JP | 2016204690 | A | 12/2016 |
| JP | 2020-204051 | A | 12/2020 |
| WO | 2008123366 | A1 | 10/2008 |
| WO | 2017017933 | A1 | 2/2017 |
| WO | 2021090642 | A1 | 5/2021 |

OTHER PUBLICATIONS

Office Action (The First Office Action) issued Aug. 19, 2025, by the State Intellectual Property Office of People's Republic of China in corresponding Chinese Patent Application No. 202280033972.3 and an English translation with Concise explanation of relevance of the Office Action. (16 pages).

Extended European Search Report issued Jul. 25, 2025, by the European Patent Office in corresponding European Patent Application No. 22804618.1-1103. (9 pages).

International Search Report and Written Opinion for International Application No. PCT/JP2022/020291, dated Jul. 19, 2022, 5 pages.

*Primary Examiner* — Anthony M Liang

(74) *Attorney, Agent, or Firm* — Buchanan Ingersoll & Rooney PC

(57) ABSTRACT

A high-strength hot-rolled steel sheet according to the present invention has a specific chemical composition and a steel microstructure including, as main phases, 80% to 100% of martensite and bainite in terms of total area fraction. An entire area fraction of the martensite dispersed in the bainite is 2% to 20%. Among the martensite dispersed in the bainite, an area fraction of martensite each having an orientation difference of less than 15° between a crystal orientation of the martensite and a crystal orientation of at least one of bainite adjacent to the martensite is 50% or more relative to the whole martensite dispersed in the bainite.

4 Claims, No Drawings

HIGH-STRENGTH HOT-ROLLED STEEL SHEET AND METHOD FOR MANUFACTURING HIGH-STRENGTH HOT-ROLLED STEEL SHEET

CROSS REFERENCE TO RELATED APPLICATIONS

This is the U.S. National Phase application of PCT/JP2022/020291, filed May 13, 2022, which claims priority to Japanese Patent Application No. 2021-083111, filed May 17, 2021, the disclosures of these applications being incorporated herein by reference in their entireties for all purposes.

FIELD OF THE INVENTION

The present invention relates to a high-strength hot-rolled steel sheet suitable as a material for automotive parts and a method for manufacturing the high-strength hot-rolled steel sheet.

BACKGROUND OF THE INVENTION

From the viewpoint of improving crash safety and fuel economy of automobiles, there is a need to increase the strength of steel sheets used for automotive parts. On the other hand, in steel sheets having increased strength, cracking due to the lack of workability occurs significantly during pressing, and thus the pressing process and workability of the steel sheets need to be improved. Over 980 MPa-grade hot-rolled steel sheets are required to have particularly high ductility in order to apply such steel sheets to parts with complicated shapes. In addition, such hot-rolled steel sheets are required to have excellent edge cracking resistance and stretch flangeability because edge cracking during shearing of materials and cracking during hole expansion work are likely to occur.

To address these requirements, various hot-rolled steel sheets have been developed as described in, for example, Patent Literature 1 to Patent Literature 3.

Patent Literature 1 discloses a technique related to a hot-rolled steel sheet having a tensile strength (TS) of 780 MPa or more and improved punching workability. The hot-rolled steel sheet has a specific composition, more than 95% of a bainite phase in terms of area fraction in the entire region in the thickness direction, and a microstructure in which an average grain size of the bainite phase in a region extending from a surface to a position ¼ of the thickness in the thickness direction is 5 μm or less on a section in the thickness direction and parallel to the rolling direction and is 4 μm or less on a section in the thickness direction and perpendicular to the rolling direction. In addition, in a region that has a width of 1/10 of the thickness in the thickness direction with a thickness center position as a center, the number of crystal grains having an aspect ratio of 5 or more and extending in the rolling direction is 7 or less.

Patent Literature 2 describes a hot-rolled steel sheet having a specific chemical composition, in which the number density of solid solute C present in a grain boundary is $1/nm^2$ or more and $4.5/nm^2$ or less, and cementite precipitated in a grain boundary in the steel sheet has a grain size of 1 μm or less. Patent Literature 2 discloses a technique related to a hot-rolled steel sheet that is free from fracture surface cracks and has a TS of 540 MPa or more. The hot-rolled steel sheet being obtained by controlling solute C and cementite in grain boundaries.

Patent Literature 3 describes a hot-rolled steel sheet having a specific chemical composition and containing, in an amount of 50% or more in terms of area fraction. Crystal grains have orientation differences of 15° or more in grain boundaries between adjacent crystal grains and have an average orientation difference of 0° to 0.5° within the crystal grains. A total of martensite, tempered martensite, and retained austenite is 2% or more and 10% or less in terms of area fraction. Furthermore, Ti is present as titanium carbide in mass % of 40% or more of Tief represented by a specific formula, and the mass of the titanium carbide having an equivalent circular grain diameter of 7 nm or more and 20 nm or less is 50% or more of the mass of all titanium carbides. Patent Literature 3 discloses a technique related to a hot-rolled steel sheet whose ductility is improved by controlling the orientation difference within crystal grains.

PATENT LITERATURE

PTL 1: Japanese Unexamined Patent Application Publication No. 2012-62562
PTL 2: International Publication No. 2008/123366
PTL 3: Japanese Unexamined Patent Application Publication No. 2016-204690

SUMMARY OF THE INVENTION

The technique of Patent Literature 1 improves Ra of a punched fracture edge surface (improves punching workability) in the hot-rolled steel sheet. However, no findings to suppress the formation of cracks are disclosed, stretch flangeability is not specifically evaluated, and there is room for improvement. The technique of Patent Literature 2 only examines the presence or absence of cracks on an edge surface of a member under specific conditions. Cracks on the edge surface of the member cannot be said to be stably improved against a change in the clearance, and there is room for improvement. While the technique of Patent Literature 3 can improve ductility, no study on edge cracking is performed, and there is room for improvement.

Aspects of the present invention have been made to solve the above problems, and an object according to aspects of the present invention is to provide a high-strength hot-rolled steel sheet that is suitable as a material for automotive parts and that has excellent ductility, excellent edge cracking resistance, and excellent stretch flangeability, and a method for manufacturing the high-strength hot-rolled steel sheet.

The term "high strength" as used herein means that TS is 980 MPa or more. The term "excellent ductility" as used herein means that a uniform elongation of a tensile test is 5.0% or more. The term "excellent edge cracking resistance" as used herein means that, in a punching test described below, in a sample punched with a clearance of 5% to 30% at intervals of 5%, it is possible to ensure 10% or more of a clearance range in which cracks parallel to the sheet surface in the sample edge surface are not formed. The term "excellent stretch flangeability" as used herein means that, in a hole expansion test described below, a hole expansion ratio is 40% or more. In accordance with aspects of the present invention, the tensile test for measuring the TS and the uniform elongation, the punching test, and the hole expansion test can be performed by methods described in Examples below.

To solve the above problems, the inventors of the present invention focused on a hard phase, which improves ductility but deteriorates edge cracking resistance and stretch flangeability, and conceived that edge cracking resistance is promoted by controlling the fraction and crystal orientation of the hard phase. As a result, when the chemical composition of the hot-rolled steel sheet is adjusted to a specific range, martensite and bainite are present as main phases, and a certain amount of martensite is dispersed in the bainite and a crystal orientation of each of the martensite dispersed in the bainite is close to crystal orientations of bainite surrounding the martensite (bainite adjacent to the martensite), edge cracking resistance is less likely to deteriorate, and high stretch flangeability is achieved. This finding led to the completion of aspects of the present invention.

Aspects of the present invention are summarized as follows.

[1] A high-strength hot-rolled steel sheet having:

a chemical composition containing, by mass %,

C: 0.04% to 0.18%,

Si: 0.1% to 3.0%,

Mn: 0.5% to 3.5%,

P: more than 0% and 0.100% or less,

S: more than 0% and 0.020% or less, and

Al: more than 0% and 1.5% or less, and further containing one or two or more selected from Cr: 0.005% to 2.0%, Ti: 0.005% to 0.20%, Nb: 0.005% to 0.20%, Mo: 0.005% to 2.0%, and V: 0.005% to 1.0%, the balance being Fe and incidental impurities; and a steel microstructure including, as main phases, 80% to 100% of martensite and bainite in terms of total area fraction, wherein an entire area fraction of the martensite dispersed in the bainite is 2% to 20%, and among the martensite dispersed in the bainite, an area fraction of the martensite each having an orientation difference of less than 15° between a crystal orientation of the martensite and a crystal orientation of at least one of the bainite adjacent to the martensite is 50% or more relative to the whole martensite dispersed in the bainite.

[2] The high-strength hot-rolled steel sheet according to [1], containing:

in addition to the chemical composition, by mass %, one or two or more selected from:

Cu: 0.05% to 4.0%,

Ni: 0.005% to 2.0%,

B: 0.0002% to 0.0050%,

Ca: 0.0001% to 0.0050%,

REM: 0.0001% to 0.0050%,

Sb: 0.0010% to 0.10%, and

Sn: 0.0010% to 0.50%.

[3] A method for manufacturing a high-strength hot-rolled steel sheet according to [1] or [2], the method including:

heating a slab having the chemical composition; and subsequently subjecting the slab to hot rolling, wherein the hot rolling includes performing rough rolling, at 1,100° C. or higher, in 3 passes or more and at a rolling reduction of 15% or more per pass, performing finish rolling under conditions in which a total rolling reduction at 1,000° C. or lower is 50% or more, and a total number of passes at 1,000° C. or lower is 3 times or more, subsequently performing natural cooling for 1.0 s or more, subsequently performing cooling under a condition in which an average cooling rate from a cooling start temperature to 550° C. is 50° C./s or more, and subsequently performing coiling at a coiling temperature of (Ms temperature—50) ° C. to 550° C.

According to aspects of the present invention, it is possible to provide a high-strength hot-rolled steel sheet that is suitable as a material for automotive parts and that has excellent ductility, excellent edge cracking resistance, and excellent stretch flangeability, and a method for manufacturing the high-strength hot-rolled steel sheet. The use of the high-strength hot-rolled steel sheet according to aspects of the present invention as a material for automotive parts enables production of, for example, high-strength automotive parts without the occurrence of cracking due to working.

DETAILED DESCRIPTION OF EMBODIMENTS OF THE INVENTION

A high-strength hot-rolled steel sheet and a method for manufacturing the high-strength hot-rolled steel sheet according to aspects of the present invention will be described in detail below. The present invention is not limited to the following embodiments.

<High-Strength Hot-Rolled Steel Sheet>

The high-strength hot-rolled steel sheet according to aspects of the present invention is a so-called black surface hot-rolled steel sheet, which is as hot-rolled, or a so-called white surface hot-rolled steel sheet, which is further pickled after hot rolling. The high-strength hot-rolled steel sheet intended in accordance with aspects of the present invention preferably has a thickness of 0.6 mm or more and 10.0 mm or less. When the high-strength hot-rolled steel sheet is used as a material for automotive parts, the thickness is more preferably 1.0 mm or more and 6.0 mm or less. The high-strength hot-rolled steel sheet preferably has a width of 500 mm or more and 1,800 mm or less, more preferably 700 mm or more and 1,400 mm or less.

The high-strength hot-rolled steel sheet according to aspects of the present invention has a specific chemical composition and a specific steel microstructure. Here, the chemical composition and the steel microstructure will be described in this order.

First, the chemical composition of the high-strength hot-rolled steel sheet according to aspects of the present invention will be described. Note that the symbol "%" representing a content in the chemical composition means "mass %".

The chemical composition of the high-strength hot-rolled steel sheet according to aspects of the present invention contains, by mass %, C: 0.04% to 0.18%, Si: 0.1% to 3.0%, Mn: 0.5% to 3.5%, P: more than 0% and 0.100% or less, S: more than 0% and 0.020% or less, and Al: more than 0% and 1.5% or less and further contains one or two or more selected from Cr: 0.005% to 2.0%, Ti: 0.005% to 0.20%, Nb: 0.005% to 0.20%, Mo: 0.005% to 2.0%, and V: 0.005% to 1.0%, with the balance being Fe and incidental impurities.

C: 0.04% to 0.18%

C is an element effective in forming and strengthening bainite and martensite to increase TS. A C content of less than 0.04% does not sufficiently provide this effect and does not achieve a TS of 980 MPa or more. On the other hand, a C content of more than 0.18% results in a marked hardening of martensite, thus failing to achieve edge cracking resistance and stretch flangeability according to aspects of the present invention. Accordingly, the C content is 0.04% to 0.18%. The C content is preferably 0.05% or more from the viewpoint of more stably achieving a TS of 980 MPa or more. The C content is preferably 0.16% or less, more preferably 0.10% or less from the viewpoint of improving edge cracking resistance and stretch flangeability.

Si: 0.1% to 3.0%

Si is an element effective in increasing TS through solid solution strengthening of steel and suppression of temper softening of martensite. Si is an element effective in suppressing the formation of cementite to obtain a microstructure in which martensite is dispersed in bainite. To provide this effect, the Si content needs to be 0.1% or more. On the other hand, a Si content of more than 3.0% results in excessive formation of polygonal ferrite, thus failing to obtain the steel microstructure according to aspects of the present invention. Accordingly, the Si content is 0.1% to 3.0%. The Si content is preferably 0.2% or more. The Si content is preferably 2.0% or less, more preferably 1.5% or less.

Mn: 0.5% to 3.5%

Mn is an element effective in forming martensite and bainite to increase TS. A Mn content of less than 0.5% does not sufficiently provide this effect, results in the formation of polygonal ferrite, etc., thus failing to obtain the steel microstructure according to aspects of the present invention. On the other hand, a Mn content of more than 3.5% suppresses the formation of bainite, thus failing to obtain the steel microstructure according to aspects of the present invention. Accordingly, the Mn content is 0.5% to 3.5%. The Mn content is preferably 1.0% or more from the viewpoint of more stably achieving a TS of 980 MPa or more. The Mn content is preferably 3.0% or less, more preferably 2.3% or less from the viewpoint of stably obtaining bainite.

P: More Than 0% and 0.100% or Less

P deteriorates edge cracking resistance, and thus the amount thereof is desirably reduced as much as possible. In accordance with aspects of the present invention, a P content of up to 0.100% is allowable. Accordingly, the P content is 0.100% or less and is preferably 0.030% or less. The P content is more than 0% and is preferably 0.001% or more because a P content of less than 0.001% causes a decrease in production efficiency.

S: More Than 0% and 0.020% or Less

S deteriorates edge cracking resistance, and thus the amount thereof is desirably reduced as much as possible. However, a S content of up to 0.020% is allowable in accordance with aspects of the present invention. Accordingly, the S content is 0.020% or less, preferably 0.0050% or less, more preferably 0.0020% or less. The S content is more than 0% and is preferably 0.0002% or more because a S content of less than 0.0002% causes a decrease in production efficiency.

Al: More Than 0% and 1.5% or Less

Al acts as a deoxidizing agent and is preferably added in a deoxidization step. The lower limit of the Al content is more than 0%. From the viewpoint of using Al as a deoxidizing agent, the Al content is preferably 0.01% or more. If Al is contained in a large amount, a large amount of polygonal ferrite may be formed, thus failing to obtain the steel microstructure according to aspects of the present invention. In accordance with aspects of the present invention, an Al content of up to 1.5% is allowable. Accordingly, the Al content is 1.5% or less. The Al content is preferably 0.50% or less.

One or Two or More Selected from Cr: 0.005% to 2.08, Ti: 0.005% to 0.20%, Nb: 0.005% to 0.20%, Mo: 0.005% to 2.0%, and V: 0.005% to 1.0%

Cr, Ti, Nb, Mo, and V are elements effective in obtaining a microstructure in which martensite is dispersed in bainite. To provide this effect, the content or contents of one or two or more elements selected from the above elements need to be equal to or higher than their respective lower limits mentioned above. On the other hand, if the content or contents of one or two or more elements selected from the above elements exceed their respective upper limits mentioned above, the effect is not provided, thus failing to obtain the steel microstructure according to aspects of the present invention. Accordingly, one or two or more selected from Cr: 0.005% to 2.0%, Ti: 0.005% to 0.20%, Nb: 0.005% to 0.20%, Mo: 0.005% to 2.0%, and V: 0.005% to 1.0% are contained. When the above elements are contained, the contents are preferably Cr: 0.1% or more, Ti: 0.010% or more, Nb: 0.010% or more, Mo: 0.10% or more, and V: 0.10% or more. When the above elements are contained, the upper limits of the contents are preferably Cr: 1.0% or less, Ti: 0.15% or less, Nb: 0.10% or less, Mo: 1.0% or less, and V: 0.5% or less.

The balance is Fe and incidental impurities. An example of incidental impurity elements is N, and the acceptable upper limit of this element is preferably 0.010%.

The above components are the basic chemical composition of the high-strength hot-rolled steel sheet according to aspects of the present invention. In accordance with aspects of the present invention, the following elements may be further contained as needed.

One or Two or More Selected From Cu: 0.05% to 4.0%, Ni: 0.005% to 2.0%, B: 0.0002% to 0.0050%, Ca: 0.0001% to 0.0050%, REM: 0.0001% to 0.0050%, Sb: 0.0010% to 0.10%, and Sn: 0.0010% to 0.50%

Cu and Ni are elements effective in forming martensite to contribute to an increase in the strength. To provide this effect, when Cu and Ni are contained, the contents thereof are preferably equal to or higher than their respective lower limits mentioned above. If the contents of Cu and Ni each exceed the respective upper limits mentioned above, the formation of bainite may be suppressed, which may fail to obtain the steel microstructure according to aspects of the present invention. The Cu content is more preferably 0.10% or more and more preferably 0.6% or less. The Ni content is more preferably 0.1% or more and more preferably 0.6% or less.

B is an element effective in improving the hardenability of a steel sheet and forming martensite to contribute to an increase in the strength. To provide this effect, when B is contained, the B content is preferably 0.0002% or more. On the other and, a B content of more than 0.0050% may increase the amounts of B-containing compounds and deteriorate the hardenability, which may fail to obtain the steel microstructure according to aspects of the present invention. Accordingly, when B is contained, the content is preferably 0.0002% to 0.0050%. The B content is more preferably 0.0005% or more and more preferably 0.0040% or less.

Ca and REM (rare-earth metal) are elements effective in improving workability due to the morphological control of inclusions. To provide this effect, when Ca and REM are contained, the contents thereof are preferably Ca: 0.0001% to 0.0050% and REM: 0.0001% to 0.0050%. If the Ca content and the REM content exceed the respective upper limits mentioned above, the amount of inclusions may increase, which may result in the deterioration of workability. The Ca content is more preferably 0.0005% or more and more preferably 0.0030% or less. The REM content is more preferably 0.0005% or more and more preferably 0.0030% or less.

Sb is an element effective in suppressing denitrification, deboronization, and the like to suppress a decrease in the strength of steel. To provide this effect, when Sb is contained, the Sb content is preferably 0.0010% to 0.10%. An Sb content of more than the upper limit mentioned above may cause embrittlement of the steel sheet. The Sb content is more preferably 0.0050% or more and more preferably 0.050% or less.

Sn is an element effective in suppressing the formation of pearlite to suppress a decrease in the strength of steel. To provide this effect, when Sn is contained, the Sn content is preferably 0.0010% to 0.50%. A Sn content of more than the upper limit mentioned above may cause embrittlement of the steel sheet. The Sn content is more preferably 0.0050% or more and more preferably 0.050% or less.

Even if the contents of Cu, Ni, B, Ca, REM, Sb, and Sn are less than the respective lower limits mentioned above, the effects according to aspects of the present invention are not impaired. Accordingly, when the contents of these components are less than their respective lower limits mentioned above, these elements are treated as being contained as incidental impurities.

Next, the steel microstructure of the high-strength hot-rolled steel sheet according to aspects of the present invention will be described below.

The steel microstructure of the high-strength hot-rolled steel sheet according to aspects of the present invention includes, as main phases, 80% to 100% of martensite and bainite in terms of total area fraction. An entire area fraction of martensite dispersed in the bainite is 2% to 20%. Among the martensite dispersed in the bainite, an area fraction of the martensite each having an orientation difference of less than 15° between a crystal orientation of the martensite and a crystal orientation of at least one of bainite adjacent to the martensite is 50% or more relative to the whole martensite dispersed in the bainite.

Total Area Fraction of Martensite and Bainite: 80% to 100%

In accordance with aspects of the present invention, in order to provide high TS and excellent edge cracking resistance and stretch flangeability, the steel microstructure mainly has martensite and bainite (includes martensite and bainite as main phases).

If the total area fraction of martensite and bainite is less than 80% relative to the whole steel sheet microstructure, at least one of high TS, edge cracking resistance, and stretch flangeability is not achieved. Accordingly, the total area fraction of martensite and bainite is 80% to 100%, preferably 83% to 100%, more preferably 88% to 100%.

Entire Area Fraction of Martensite Dispersed in Bainite: 2% to 20%

Martensite is a steel microstructure effective in increasing TS and, furthermore, is a steel microstructure effective in increasing the uniform elongation when being dispersed in bainite. To provide this effect, an entire area fraction of martensite dispersed in the bainite needs to be 2% or more. On the other hand, if the entire area fraction of the above-mentioned martensite is more than 20%, at least one of the uniform elongation, edge cracking resistance, and stretch flangeability is not obtained. Accordingly, the entire area fraction of the above-mentioned martensite is 2% to 20%. The entire area fraction of the above-mentioned martensite is preferably 3% or more, more preferably 4% or more. The entire area fraction of the above-mentioned martensite is preferably 15% or less, more preferably 12% or less.

Among Martensite Dispersed in Bainite, Area Fraction of Martensite Each Having Orientation Difference of Less Than 15° between Crystal Orientation of the Martensite and Crystal Orientation of at Least One of Bainite Adjacent to the Martensite: 50% or More Relative to Whole Martensite Dispersed in the Bainite Among martensite dispersed in the bainite, when an area fraction of martensite each having an orientation difference of less than 15° between a crystal orientation of the martensite and a crystal orientation of at least one of the bainite adjacent to the martensite (hereinafter, may also be referred to as a "dispersed martensite phase") is 50% or more relative to the whole martensite dispersed in the bainite, edge cracking resistance can be improved. As a result, stretch flangeability according to aspects of the present invention is achieved.

Herein, above-mentioned "martensite having an orientation difference of less than 15° between a crystal orientation of the martensite and a crystal orientation of at least one of bainite adjacent to the martensite" means that, for example, when a martensite surrounded by bainite having multiple of crystal orientations is present, it is sufficient that the orientation difference between one or more of the bainite having the multiple of crystal orientations and the crystal orientation of the martensite is less than 15°.

Although a detailed reason for this is not clear, it is presumably because when a martensite dispersed in the bainite has a crystal orientation close to crystal orientations of the bainite surrounding the martensite (bainite adjacent to the martensite), deformations of the bainite and the martensite conform to each other during shearing, and void formation is suppressed. For this reason, for example, edge crack resistance is considered to be improved.

For this reason, in accordance with aspects of the present invention, the area fraction of the above-mentioned dispersed martensite phase is 50% or more. When martensite having small orientation differences and being capable of suppressing void formation is 50% or more, the effect of suppressing void linkage is increased, and cracking is significantly suppressed.

Accordingly, among martensite dispersed in the bainite, the area fraction of the above-mentioned dispersed martensite phase is 50% or more relative to the whole martensite dispersed in the bainite. The area fraction is preferably 60% or more, more preferably 70% or more. The upper limit of the area fraction is not particularly specified. The area fraction is preferably 99% or less, more preferably 98% or less.

Herein, the dispersed martensite phase can be determined by a method described in Examples below. First, crystal orientations of bainite and martensite are determined by electron backscatter diffraction (EBSD), and boundaries having an orientation difference of 15° or more are displayed. Thus, above-mentioned area fraction of martensite each having an orientation difference of less than 15° between a crystal orientation of the martensite and a crystal orientation of at least one of the bainite adjacent to the martensite (adjacent bainite) is determined.

Microstructures other than the martensite and bainite described above are ferrite, pearlite, and retained austenite. Total area fraction of the microstructures other than martensite and bainite is less than 20%. When the total area fraction is less than 208, the characteristics according to aspects of the present invention can be achieved.

In accordance with aspects of the present invention, the area fractions of the microstructures and the crystal orientations of martensite and bainite can be measured by methods described in Examples below.

<Method for Manufacturing High-Strength Hot-Rolled Steel Sheet>

The high-strength hot-rolled steel sheet according to aspects of the present invention is manufactured by heating a slab having the chemical composition described above, and subsequently subjecting the slab to hot rolling. In the hot rolling, the heated slab is subjected to rough rolling, at 1,100° C. or higher, in 3 passes or more and at a rolling reduction of 15% or more per pass, subjected to finish rolling under conditions in which a total rolling reduction at 1,000° C. or lower is 50% or more and a total number of passes at 1,000° C. or lower is 3 times or more, subsequently subjected to natural cooling for 1.0 s or more, subsequently cooled under a condition in which an average cooling rate from a cooling start temperature to 550° C. is 50° C./s or more, subsequently coiled at a coiling temperature of (Ms temperature—50) ° C. to 550° C., and cooled to room temperature.

The manufacturing method will be described in detail below. The temperature described above is the temperature (surface temperature) at a central portion of the width of the slab or steel sheet, and the average cooling rate described above is the average cooling rate at a central portion of the width of the steel sheet. These temperatures can be measured with, for example, a radiation thermometer.

Number of Passes at 1,100° C. or Higher: 3 Times or More

In the rough rolling of the hot rolling, when the number of passes at 1,100° C. or higher is 3 times or more, sizes of austenite grains become uniform to eliminate non-uniformity. Consequently, among martensite dispersed in bainite, area fraction of martensite each having an orientation difference of less than 15° between a crystal orientation of the martensite and a crystal orientation of at least one of the bainite adjacent to the martensite stably becomes 50% or more relative to the whole martensite dispersed in the bainite. If the number of passes at 1, 100° C. or higher is less than 3 times, this effect is not sufficiently provided. Accordingly, the number of passes at 1, 100° C. or higher is 3 times or more. The number of passes at 1,100° C. or higher is preferably 4 times or more, more preferably 5 times or more. The upper limit of the number of passes at 1,100° C. or higher is not particularly specified. However, a number of passes of more than 15 times may cause an obstruction of manufacturability, such as an increase in scale loss, and thus the number of passes at 1,100° C. or higher is preferably 15 times or less.

Rolling Reduction Per Pass at 1,100° C. Or Higher: 15% or More

In the rough rolling of the hot rolling, if the rolling reduction per pass at 1,100° C. or higher is less than 15%, non-uniformity of austenite grains is not eliminated but is deteriorated instead, and martensite having the characteristic of the crystal orientation is not sufficiently obtained. Accordingly, the rolling reduction per pass at 1,100° C. or higher is 15% or more. The rolling reduction per pass at 1, 100° C. or higher is preferably 18% or more, more preferably 20% or more. The upper limit of the rolling reduction per pass at 1,100° C. or higher is not particularly specified. However, the rolling reduction is preferably 60% or less because a rolling reduction of more than 60% may cause deterioration of the sheet shape or a manufacturing trouble.

Total Rolling Reduction at 1,000° C. or Lower: 50% or More

In the finish rolling of the hot rolling, when the total rolling reduction at 1,000° C. or lower is 50% or more, the above-described dispersed martensite phase having the crystal orientation according to aspects of the present invention (that is, an orientation difference of less than 15° between a crystal orientation of martensite and a crystal orientation of at least one of bainite adjacent to the martensite) can be 50% or more relative to the whole martensite phase dispersed in bainite phase.

Although a detailed reason for this is not clear, it is presumably because orientation selections during each of bainite transformation and martensite transformation from austenite are restricted by the reduction under the above-described condition. Accordingly, the total rolling reduction at 1,000° C. or lower in the finish rolling of the hot rolling is 50% or more. The total rolling reduction is preferably 60% or more. The upper limit of the total rolling reduction is not particularly specified. Since an excessively high total rolling reduction develops a texture and may impair workability such as stretch flangeability, the total rolling reduction is preferably 90% or less.

Herein, the total rolling reduction is a percentage of a value determined by dividing the difference between a sheet thickness at the entry before the first pass in the above temperature region and a sheet thickness at the exit after the last pass in the temperature region by the sheet thickness at the entry before the first pass.

Specifically, the total rolling reduction is determined by (sheet thickness at entry before first pass in the temperature region−sheet thickness at exit after last pass in the temperature region)/(sheet thickness at entry before first pass in the temperature region)×100(%).

Total Number of Passes at 1,000° C. or Lower: 3 Times or More

In the finish rolling of the hot rolling, when the reduction at 1,000° C. or lower is divided into multiple times to decrease the rolling reduction per pass, martensite having an orientation close to the crystal orientation of bainite (that is, a martensite having an orientation difference of less than 15° from s crystal orientation of at least one of adjacent bainite) is likely to be formed. When the total number of passes is 3 times or more, the steel microstructure according to aspects of the present invention can be provided (that is, an area fraction of martensite each having an orientation difference of less than 15° from a crystal orientation of at least one of adjacent bainite can be 50% or more relative to the whole martensite dispersed in the bainite). The total number of passes is preferably 4 times or more. The upper limit of the total number of passes is not particularly specified. The total number of passes is preferably 10 times or less in view of, for example, production efficiency.

Finishing Delivery Temperature (Preferred Condition)

The finishing delivery temperature is preferably 750° C. to 1,000° C. Controlling the finishing delivery temperature to 750° C. to 1,000° C. makes it easy to provide stable surface quality. The finishing delivery temperature is more preferably 780° C. or higher and more preferably 950° C. or lower.

Natural Cooling Time after Finish Rolling: 1.0 s or More

If the natural cooling time after the finish rolling is less than 1.0 s (second), the area fraction of the dispersed martensite phase having the crystal orientation according to aspects of the present invention relative to the whole martensite phase dispersed in the bainite phase cannot be adjusted to 50% or more. Although the reason for this is not clear, presumably, dislocations introduced by the finish rolling are partially recovered by the natural cooling and may affect the orientation selections during the subsequent bainite transformation and martensite transformation. Accordingly, the natural cooling time after the finish rolling is 1.0 s or more. The natural cooling time is preferably 1.5 s or more. The upper limit of the natural cooling time is not particularly specified. Natural cooling for 10 s or more may result in the formation of a microstructure that is not desired in accordance with aspects of the present invention, such as ferrite, and thus the natural cooling time is preferably 10 s or less.

Average Cooling Rate from Cooling Start Temperature to 550° C.: 50° C./s or More An average cooling rate from the cooling start temperature to 550° C. of less than 50° C./s results in the formation of ferrite and pearlite, thus failing to obtain the steel microstructure according to aspects of the present invention. Accordingly, the average cooling rate from the cooling start temperature to 550° C. is 50° C./s or more. The average cooling rate is preferably 80° C./s or more. The upper limit of the average cooling rate is not particularly specified; however, the average cooling rate is preferably 1,000° C./s or less from the viewpoint of, for example, the shape stability of the steel sheet.

Since a cooling start temperature of lower than 700° C. tends to form ferrite, the cooling start temperature is preferably 700° C. or higher. The cooling start temperature is more preferably 720° C. or higher. Furthermore, since it is technically difficult to make the cooling start temperature higher than the finishing delivery temperature, the cooling start temperature is preferably equal to or lower than the finishing delivery temperature.

Coiling Temperature: (Ms Temperature—50)° C. to 550° C.

A coiling temperature of lower than (Ms Temperature—50) ° C. results in an increase in martensite, thus failing to obtain the steel microstructure according to aspects of the present invention. On the other hand, a coiling temperature of higher than 550° C. results in the formation of ferrite and pearlite, thus failing to obtain the steel microstructure according to aspects of the present invention. Accordingly, the coiling temperature is (Ms temperature—50) ° C. to 550° C. The coiling temperature is preferably (Ms temperature—30) ° C. or higher and preferably 520° C.

Herein, the Ms temperature is the martensite transformation start temperature and can be determined by performing actual measurement, such as electric resistance measurement or thermal expansion measurement during cooling by a formaster test or the like.

Conditions other than those of the manufacturing method described above are not particularly limited; however, the manufacturing is preferably performed while the conditions are appropriately adjusted as described below.

For example, the heating temperature of the slab is preferably 1,100° C. or higher from the viewpoints of, for example, removing segregation and dissolving precipitates, and is preferably 1, 300° C. or lower from the viewpoint of, for example, energy efficiency.

The finish rolling is preferably performed in 4 or more passes from the viewpoint of, for example, decreasing coarse grains, which may cause deterioration of workability. Note that this number of passes of the finish rolling refers to a total number of passes in the finish rolling and includes the above-mentioned "total number of passes at 1,000° C. or lower" described above.

EXAMPLES

Aspects of the present invention will be further described with reference to Examples below. The present invention is not limited to the following Examples.

Steels having respective chemical compositions shown in Table 1 were obtained by steelmaking in a vacuum melting furnace to manufacture slabs. Subsequently, the slabs were heated to 1, 200° C. and subjected to hot rolling under the conditions shown in Table 2 to produce hot-rolled steel sheets. In the hot rolling, the total number of passes of finish rolling was 7 passes.

A blank in Table 1 means that the element is not intentionally added and refers to not only the case where the element is not contained (0%) but also the case where the element is incidentally contained. N is an incidental impurity.

The resulting hot-rolled steel sheets were subjected to microstructure observation and evaluations of tensile properties, edge cracking resistance, and stretch flangeability in accordance with test methods described below.

<Microstructure Observation>

(Area Fraction of Each Microstructure)

The area fractions of martensite and bainite are the ratios of the areas of the respective microstructures to the area of observation.

The area fraction of martensite is determined as follows.

A sample was cut out from the resulting hot-rolled steel sheet. A cross section of the sample that was taken in the thickness direction so as to be parallel to the rolling direction was polished and then etched in 3% nital. Images of the cross section at a position ¼ of the thickness were captured with a scanning electron microscope (SEM) at a magnification of 1,500× in three fields of view. The area fraction of each microstructure was determined from the image data of the obtained secondary electron images using Image-Pro available from Media Cybernetics, Inc., and the average area fraction of the fields of view was defined as the area fraction of each microstructure.

In the image data, upper bainite is distinguished as black or dark gray containing carbide or martensite having linear interfaces. Lower bainite is distinguished as black, dark gray, gray, or light gray containing uniformly oriented carbides. Martensite is distinguished as black, dark gray, gray, or light gray containing carbide having multiple orientations, or white or light gray containing no carbide. Retained austenite is distinguished as white or light gray containing no carbide.

In some cases, martensite and retained austenite cannot be distinguished from each other. Accordingly, the area fraction of martensite was determined by subtracting the area fraction of retained austenite determined by a method described below from the total area fraction of martensite and retained austenite determined from the SEM images.

In accordance with aspects of the present invention, the martensite may be any martensite, such as fresh martensite, autotempered martensite, or tempered martensite. The bainite may be any bainite, such as upper bainite, lower bainite, or tempered bainite.

A microstructure subjected to a higher degree of tempering provides a contrast image in which the matrix appears blacker. Therefore, the colors of the above matrices serve only as a guide. In accordance with aspects of the present invention, the microstructures were identified in comprehensive consideration of the amount of carbide, the microstructural morphology, and the like and classified into any of microstructures having similar characteristics and including microstructures described below. Carbides appear white dots or lines.

Although ferrite is not basically contained in accordance with aspects of the present invention, ferrite can be distinguished as a black microstructure, a dark gray microstructure having no or a very small amount of carbide inside, or a dark gray microstructure having no linear interface with martensite. Pearlite can be distinguished as a black and white lamellar or partially interrupted lamellar microstructure.

The area fraction of retained austenite was determined as follows. A steel sheet after annealing was ground to a position of ¼ of the thickness of the sheet+0.1 mm and then further polished by 0.1 mm by chemical polishing. For the polished surface, integrated reflection intensities of (200), (220), and (311) planes of fcc iron (austenite) and (200), (211), and (220) planes of bcc iron (ferrite) were measured with an X-ray diffractometer using Mo-Kal radiation. The volume fraction was determined from the intensity ratios of the integrated reflection intensities from the above planes of fcc iron to the integrated reflection intensities from the above planes of bcc iron. This volume fraction was used as the area fraction of retained austenite.

The total area fraction of bainite and martensite and the total area fraction of other microstructures are determined using the obtained area fractions of the respective microstructures, and the total area fractions are shown in Table 3. In Table 3, "V (M)" means the area fraction (%) of martensite, "V(B+M)" means the total area fraction (%) of bainite and martensite, and "V (O)" means the total area fraction (%) of the other microstructures.

(Crystal Orientation)

Crystal orientations of bainite and martensite are determined by electron backscatter diffraction (EBSD) for the same field of view of the same sample used for the microstructure observation, and boundaries having orientation differences of 15° or more are displayed. Thus, among martensite dispersed in bainite, an area fraction of martensite each having an orientation difference of less than 15° between a crystal orientation of the martensite and a crystal orientation of at least one of bainite adjacent to the martensite was determined. A ratio of the area fraction of the relevant martensite to the area fraction of the whole martensite was determined. The EBSD measurement was performed at an accelerating voltage of 30 kV and a step size of 0.05 μm in a region of 100 μm×100 μm.

The resulting ratio is shown in Table 3. The "Ratio of M having orientation difference of less than 15° from adjacent B" in Table 3 indicates the above ratio (%).

<Tensile Test>

The evaluation of tensile properties was performed by a tensile test. JIS No. 5 test pieces for a tensile test (JIS Z 2201) were collected from the resulting hot-rolled steel sheets in a direction parallel to the rolling direction. The tensile test was performed in accordance with JIS Z 2241 at a strain rate of 10-3/s to determine the TS and the uniform elongation.

In accordance with aspects of the present invention, a TS of 980 MPa or more and a uniform elongation of 5.0% or more were each evaluated as pass.

<Punching Test>

The evaluation of edge cracking resistance was performed by a punching test. Test specimens with a width of 150 mm and a length of 150 mm were collected from the resulting hot-rolled steel sheets. Each of the test specimens was punched using a punch with a diameter Φ of 10 mm three times under the conditions in which the clearance was 5%, 10%, 158, 20%, 25%, and 30%. The presence or absence of cracks parallel to the surface (sheet surface) in the punched edge surface was examined to evaluate edge cracking resistance. When a clearance range in which no cracks were formed was 10% or more, the edge cracking resistance was evaluated as pass. For example, in the punching test performed by the above method, when no cracks are formed with a clearance of 10%, 15%, 20%, and 25%, the clearance range in which no cracks were formed is determined as the difference between 25%, which is the maximum clearance at which no cracks were formed, and 10%, which is the minimum clearance, and thus is 15%.

<Hole Expansion Test>

Stretch flangeability was evaluated by a hole expansion test. Three test specimens punched under the condition in which the clearance was 10% in the above punching test were subjected to a hole expansion test three times with a conical punch having a cone angle of 60° in accordance with JEST 1001 (The Japan Iron and Steel Federation Standard, 2008). The average hole expansion ratio (%) was determined and used as the hole expansion ratio. A hole expansion ratio of 40 or more was evaluated as pass.

Table 3 shows various evaluation results.

TABLE 1

| | Chemical composition (mass %) | | | | | | | | |
|---|---|---|---|---|---|---|---|---|---|
| Steel | C | Si | Mn | P | S | Al | N | Others | Remarks |
| A | 0.11 | 0.50 | 1.7 | 0.014 | 0.0018 | 0.031 | 0.003 | Ti: 0.060 | Within scope of invention |
| B | 0.07 | 0.30 | 2.0 | 0.023 | 0.0022 | 0.033 | 0.002 | Nb: 0.060 | Within scope of invention |
| C | 0.04 | 1.00 | 2.1 | 0.015 | 0.0029 | 0.036 | 0.004 | Mo: 0.30 | Within scope of invention |
| D | 0.11 | 0.10 | 3.3 | 0.008 | 0.0014 | 0.038 | 0.003 | V: 0.20 | Within scope of invention |
| E | 0.17 | 0.70 | 2.4 | 0.004 | 0.0004 | 0.027 | 0.003 | Ti: 0.03, Cu: 0.2, Ca: 0.0010, Sn: 0.04 | Within scope of invention |
| F | 0.05 | 0.90 | 2.5 | 0.015 | 0.0018 | 0.044 | 0.003 | Nb: 0.04, REM: 0.0020, Sb: 0.010 | Within scope of invention |
| G | 0.06 | 0.40 | 0.7 | 0.010 | 0.0014 | 0.082 | 0.002 | Cr: 0.30, Ni: 0.60, Ti: 0.080, B: 0.0020 | Within scope of invention |
| H | 0.03 | 0.30 | 1.9 | 0.010 | 0.0021 | 0.019 | 0.006 | Cr: 0.30 | Outside scope of invention |
| I | 0.19 | 0.50 | 2.2 | 0.009 | 0.0013 | 0.015 | 0.004 | Ti: 0.040 | Outside scope of invention |
| J | 0.09 | 3.10 | 1.8 | 0.010 | 0.0012 | 0.028 | 0.003 | Nb: 0.020 | Outside scope of invention |
| K | 0.10 | 0.50 | 0.4 | 0.013 | 0.0016 | 0.036 | 0.003 | Mo: 0.30 | Outside scope of invention |
| L | 0.05 | 0.40 | 3.9 | 0.011 | 0.0010 | 0.035 | 0.004 | V: 0.10 | Outside scope of invention |
| M | 0.13 | 0.10 | 2.2 | 0.018 | 0.0008 | 0.033 | 0.003 | - | Outside scope of invention |
| N | 0.15 | 1.40 | 2.4 | 0.003 | 0.0004 | 0.030 | 0.004 | Ti: 0.03, Mo: 0.4, B: 0.0020 | Within scope of invention |
| O | 0.10 | 1.00 | 2.4 | 0.012 | 0.0005 | 0.029 | 0.004 | Cr: 0.8 | Within scope of invention |
| P | 0.10 | 1.00 | 2.4 | 0.012 | 0.0006 | 0.029 | 0.003 | Cr: 2.3 | Outside scope of invention |
| Q | 0.10 | 1.00 | 2.4 | 0.012 | 0.0006 | 0.030 | 0.003 | Ti: 0.23 | Outside scope of invention |
| R | 0.10 | 1.00 | 2.4 | 0.011 | 0.0005 | 0.031 | 0.003 | Nb: 0.22 | Outside scope of invention |
| S | 0.10 | 1.00 | 2.4 | 0.011 | 0.0007 | 0.030 | 0.003 | Mo: 2.1 | Outside scope of invention |
| T | 0.10 | 1.00 | 2.4 | 0.012 | 0.0006 | 0.030 | 0.003 | V: 2.1 | Outside scope of invention |

* Underlined portions are outside the scope of the present invention.

TABLE 2

| Steel sheet No. | Steel | Total number of passes at 1,100° C. or higher (times) | Rolling reduction per pass at 1,100° C. or higher (%) | Total rolling reduction at 1,000° C. or lower (%) | Total number of passes at 1,000° C. or lower (times) | Finishing delivery temperature (° C.) | Natural cooling time after finish rolling (s) | Average cooling rate from cooling start temperature to 550° C. (° C./s) | Coiling temperature (° C.) | Ms temperature (° C.) | Remarks |
|---|---|---|---|---|---|---|---|---|---|---|---|
| 1 | A | 3 | 48 | 70 | 4 | 900 | 1.0 | 200 | 480 | 444 | Inventive Example |
| 2 | | 3 | 48 | 45 | 4 | 900 | 1.0 | 200 | 480 | 444 | Comparative Example |
| 3 | B | 6 | 30 | 50 | 3 | 930 | 1.5 | 60 | 450 | 447 | Inventive Example |
| 4 | | 6 | 30 | 50 | 3 | 930 | 1.5 | 60 | 380 | 447 | Comparative Example |
| 5 | C | 5 | 35 | 70 | 4 | 890 | 2.0 | 100 | 460 | 452 | Inventive Example |
| 6 | | 5 | 35 | 70 | 4 | 890 | 0.4 | 100 | 460 | 452 | Comparative Example |
| 7 | D | 5 | 35 | 80 | 4 | 850 | 3.0 | 50 | 530 | 382 | Inventive Example |
| 8 | E | 4 | 40 | 70 | 5 | 880 | 2.5 | 100 | 450 | 395 | Inventive Example |
| 9 | | 4 | 40 | 70 | 5 | 880 | 2.5 | 30 | 450 | 395 | Comparative Example |
| 10 | | 4 | 40 | 70 | 2 | 880 | 2.5 | 100 | 450 | 395 | Comparative Example |
| 11 | | 4 | 40 | 70 | 5 | 880 | 2.5 | 100 | 580 | 395 | Comparative Example |
| 12 | F | 8 | 20 | 70 | 4 | 830 | 1.5 | 100 | 400 | 418 | Inventive Example |
| 13 | G | 7 | 25 | 70 | 4 | 820 | 1.5 | 100 | 500 | 501 | Inventive Example |
| 14 | H | 5 | 35 | 70 | 4 | 870 | 1.5 | 100 | 470 | 465 | Comparative Example |
| 15 | I | 5 | 35 | 70 | 4 | 870 | 1.5 | 100 | 400 | 396 | Comparative Example |
| 16 | J | 5 | 35 | 70 | 4 | 870 | 1.5 | 100 | 500 | 447 | Comparative Example |
| 17 | K | 5 | 35 | 70 | 4 | 870 | 1.5 | 100 | 500 | 497 | Comparative Example |
| 18 | L | 5 | 35 | 70 | 4 | 870 | 1.5 | 100 | 370 | 380 | Comparative Example |
| 19 | M | 5 | 35 | 70 | 4 | 870 | 1.5 | 100 | 500 | 417 | Comparative Example |
| 20 | N | 5 | 35 | 70 | 4 | 870 | 1.5 | 100 | 430 | 400 | Inventive Example |
| 21 | A | 2 | 30 | 70 | 4 | 900 | 1.0 | 200 | 480 | 444 | Comparative Example |
| 22 | E | 7 | 12 | 70 | 5 | 880 | 2.5 | 100 | 450 | 395 | Comparative Example |
| 23 | F | 2 | 12 | 70 | 4 | 830 | 1.5 | 100 | 400 | 418 | Comparative Example |
| 24 | O | 5 | 35 | 70 | 4 | 870 | 1.5 | 100 | 400 | 404 | Inventive Example |
| 25 | P | 5 | 35 | 70 | 4 | 870 | 1.5 | 100 | 400 | 374 | Comparative Example |
| 26 | Q | 5 | 35 | 70 | 4 | 870 | 1.5 | 100 | 400 | 420 | Comparative Example |
| 27 | R | 5 | 35 | 70 | 4 | 870 | 1.5 | 100 | 400 | 420 | Comparative Example |
| 28 | S | 5 | 35 | 70 | 4 | 870 | 1.5 | 100 | 400 | 408 | Comparative Example |
| 29 | T | 5 | 35 | 70 | 4 | 870 | 1.5 | 100 | 400 | 420 | Comparative Example |

* Underlined portions are outside the scope of the present invention.

TABLE 3

| | Steel microstructure | | | | Mechanical properties | | | | |
|---|---|---|---|---|---|---|---|---|---|
| Steel sheet No. | V(M + B) (%) | V(M) (%) | V(O) (%) | Ratio of M having orientation difference of less than 15° from adjacent B (%) | TS (MPa) | Uniform elongation (%) | Clearance range in which no edge cracks are formed (%) | Hole expansion ratio (%) | Remarks |
| 1 | 100 | 5 | 0 | 80 | 1039 | 7.6 | 15 | 58 | Inventive Example |
| 2 | 100 | 6 | 0 | 37 | 1044 | 7.9 | 5 | 38 | Comparative Example |
| 3 | 100 | 4 | 0 | 70 | 1020 | 7.0 | 10 | 85 | Inventive Example |
| 4 | 100 | 53 | 0 | 50 | 1113 | 4.2 | 10 | 59 | Comparative Example |
| 5 | 97 | 9 | 3 | 87 | 1088 | 9.0 | 15 | 68 | Inventive Example |
| 6 | 97 | 8 | 3 | 33 | 1101 | 9.2 | 5 | 39 | Comparative Example |
| 7 | 100 | 16 | 0 | 76 | 1165 | 6.5 | 15 | 55 | Inventive Example |
| 8 | 98 | 13 | 2 | 89 | 1185 | 8.4 | 15 | 41 | Inventive Example |
| 9 | 87 | 23 | 13 | 55 | 1191 | 8.8 | 15 | 17 | Comparative Example |
| 10 | 99 | 16 | 1 | 45 | 1181 | 8.7 | 5 | 39 | Comparative Example |
| 11 | 66 | 3 | 34 | 87 | 1097 | 7.2 | 15 | 33 | Comparative Example |
| 12 | 99 | 17 | 1 | 61 | 1090 | 6.2 | 15 | 66 | Inventive Example |
| 13 | 100 | 3 | 0 | 86 | 994 | 7.5 | 15 | 77 | Inventive Example |
| 14 | 100 | 2 | 0 | 70 | 948 | 5.6 | 15 | 93 | Comparative Example |
| 15 | 99 | 18 | 1 | 64 | 1142 | 9.8 | 5 | 18 | Comparative Example |
| 16 | 59 | 3 | 41 | 53 | 1165 | 9.5 | 5 | 37 | Comparative Example |
| 17 | 92 | 0 | 8 | - | 943 | 4.5 | 15 | 91 | Comparative Example |
| 18 | 97 | 82 | 3 | 81 | 1152 | 4.3 | 5 | 52 | Comparative Example |
| 19 | 100 | 1 | 0 | 62 | 1031 | 4.7 | 15 | 78 | Comparative Example |
| 20 | 89 | 15 | 11 | 66 | 1266 | 7.6 | 10 | 43 | Inventive Example |
| 21 | 100 | 7 | 0 | 42 | 1026 | 7.9 | 5 | 37 | Comparative Example |
| 22 | 97 | 16 | 3 | 46 | 1168 | 9.0 | 5 | 33 | Comparative Example |
| 23 | 97 | 18 | 3 | 37 | 1055 | 6.8 | 5 | 25 | Comparative Example |
| 24 | 97 | 17 | 3 | 65 | 1078 | 6.6 | 10 | 56 | Inventive Example |
| 25 | 100 | 72 | 0 | 84 | 1206 | 4.4 | 10 | 75 | Comparative Example |
| 26 | 98 | 53 | 2 | 60 | 1241 | 5.5 | 5 | 48 | Comparative Example |

TABLE 3-continued

| | Steel microstructure | | | | Mechanical properties | | | | |
|---|---|---|---|---|---|---|---|---|---|
| Steel sheet No. | V(M + B) (%) | V(M) (%) | V(O) (%) | Ratio of M having orientation difference of less than 15° from adjacent B (%) | TS (MPa) | Uniform elongation (%) | Clearance range in which no edge cracks are formed (%) | Hole expansion ratio (%) | Remarks |
| 27 | 97 | 56 | 3 | 65 | 1263 | 5.4 | 10 | 35 | Comparative Example |
| 28 | 98 | 86 | 2 | 75 | 1289 | 4.8 | 10 | 60 | Comparative Example |
| 29 | 98 | 83 | 2 | 78 | 1250 | 4.8 | 0 | 23 | Comparative Example |

* Underlined portions are outside the scope of the present invention.

Referring to Table 3, all Inventive Examples provide high-strength hot-rolled steel sheets having an excellent uniform elongation, excellent edge cracking resistance, and excellent stretch flangeability. In contrast, in Comparative Examples, which are outside the scope of the present invention, one or more of the desired strength, uniform elongation, edge cracking resistance, and stretch flangeability are not achieved.

INDUSTRIAL APPLICABILITY

According to aspects of the present invention, it is possible to provide a high-strength hot-rolled steel sheet having a TS of 980 MPa or more, excellent ductility, excellent edge cracking resistance, and excellent stretch flangeability. The use of the high-strength hot-rolled steel sheet according to aspects of the present invention for automotive parts can contribute greatly to the improvements in crash safety and fuel economy of automobiles.

The invention claimed is:

1. A hot-rolled steel sheet comprising:
a chemical composition containing, by mass %,
C: 0.04% to 0.18%,
Si: 0.1% to 3.0%,
Mn: 0.5% to 3.5%,
P: more than 0% and 0.100% or less,
S: more than 0% and 0.020% or less, and
Al: more than 0% and 1.5% or less, and
further containing one or two or more selected from Cr: 0.005% to 2.0%, Ti: 0.005% to 0.20%, Nb: 0.005% to 0.20%, Mo: 0.005% to 2.0%, and V: 0.005% to 1.0%,
the balance being Fe and incidental impurities; and
a steel microstructure including, as main phases, 80% to 100% of martensite and bainite in terms of total area fraction,
wherein an entire area fraction of the martensite dispersed in the bainite is 2% to 20%, and
among the martensite dispersed in the bainite, an area fraction of the martensite each having an orientation difference of less than 15° between a crystal orientation of the martensite and a crystal orientation of at least one of the bainite adjacent to the martensite is 50% or more relative to the whole martensite dispersed in the bainite.

2. The hot-rolled steel sheet according to claim 1, comprising:
in addition to the chemical composition, by mass %, one or two or more selected from:
Cu: 0.05% to 4.0%,
Ni: 0.005% to 2.0%,
B: 0.0002% to 0.0050%,
Ca: 0.0001% to 0.0050%,
REM: 0.0001% to 0.0050%,
Sb: 0.0010% to 0.10%, and
Sn: 0.0010% to 0.50%.

3. A method for manufacturing the hot-rolled steel sheet according to claim 1, the method comprising:
heating a slab having the chemical composition; and
subsequently subjecting the slab to hot rolling,
wherein the hot rolling includes performing rough rolling, at 1,100° C. or higher, in 3 passes or more and at a rolling reduction of 15% or more per pass, performing finish rolling under conditions in which a total rolling reduction at 1,000° C. or lower is 50% or more, and a total number of passes at 1,000° C. or lower is 3 times or more, subsequently performing natural cooling for 1.0 s or more, subsequently performing cooling under a condition in which an average cooling rate from a cooling start temperature to 550° C. is 50° C./s or more, and subsequently performing coiling at a coiling temperature of (Ms temperature—50° C.) to 550° C.

4. A method for manufacturing the hot-rolled steel sheet according to claim 2, the method comprising:
heating a slab having the chemical composition; and
subsequently subjecting the slab to hot rolling,
wherein the hot rolling includes performing rough rolling, at 1,100° C. or higher, in 3 passes or more and at a rolling reduction of 15% or more per pass, performing finish rolling under conditions in which a total rolling reduction at 1,000° C. or lower is 50% or more, and a total number of passes at 1,000° C. or lower is 3 times or more, subsequently performing natural cooling for 1.0 s or more, subsequently performing cooling under a condition in which an average cooling rate from a cooling start temperature to 550° C. is 50° C./s or more, and subsequently performing coiling at a coiling temperature of (Ms temperature-50° C.) to 550° C.

* * * * *